US009346616B2

(12) United States Patent
Foster

(10) Patent No.: US 9,346,616 B2
(45) Date of Patent: May 24, 2016

(54) WASTE CONTAINER WITH IMPROVED LATCH

(75) Inventor: Derick Foster, Huntington Beach, CA (US)

(73) Assignee: Rehrig Pacific Company, Los Angeles, CA (US)

( * ) Notice: Subject to any disclaimer, the term of this patent is extended or adjusted under 35 U.S.C. 154(b) by 66 days.

(21) Appl. No.: 13/226,665

(22) Filed: Sep. 7, 2011

(65) Prior Publication Data

US 2012/0055930 A1 Mar. 8, 2012

Related U.S. Application Data

(60) Provisional application No. 61/380,557, filed on Sep. 7, 2010, provisional application No. 61/451,738, filed on Mar. 11, 2011.

(51) Int. Cl.

| | |
|---|---|
| ***B65D 43/22*** | (2006.01) |
| ***B65D 45/16*** | (2006.01) |
| ***B65F 1/12*** | (2006.01) |
| ***B65F 1/14*** | (2006.01) |
| *B65D 43/16* | (2006.01) |

(52) U.S. Cl.

CPC ..... *B65F 1/122* (2013.01); *B65F 1/1473* (2013.01); *B65F 1/1615* (2013.01); *B65F 1/1646* (2013.01)

(58) Field of Classification Search

USPC ..... 220/325, 324, 908, 835

See application file for complete search history.

(56) References Cited

U.S. PATENT DOCUMENTS

| | | | | |
|---|---|---|---|---|
| 372,680 | A * | 11/1887 | Ketcham | 292/149 |
| 3,490,637 | A * | 1/1970 | Pope | 220/3.4 |
| 4,319,762 | A * | 3/1982 | Streit et al. | 280/79.2 |
| 4,384,656 | A * | 5/1983 | McQuiston et al. | 220/323 |
| 5,490,606 | A * | 2/1996 | Lombardo | 220/324 |
| 5,960,983 | A * | 10/1999 | Chan | 220/666 |
| 6,250,492 | B1 * | 6/2001 | Verbeek | 220/495.11 |
| 6,350,418 | B1 * | 2/2002 | Venderpool et al. | 422/297 |
| 7,073,677 | B2 * | 7/2006 | Richardson et al. | 220/4.32 |
| 7,559,433 | B2 * | 7/2009 | Yang et al. | 220/832 |
| 7,918,362 | B2 * | 4/2011 | Schmitt | 220/665 |
| 2006/0043099 | A1 * | 3/2006 | Zer et al. | 220/835 |
| 2009/0223965 | A1 * | 9/2009 | Raghunathan et al. | 220/324 |
| 2009/0245981 | A1 * | 10/2009 | Miyajima et al. | 414/222.02 |
| 2012/0000909 | A1 * | 1/2012 | Chameroy et al. | 220/324 |

* cited by examiner

*Primary Examiner* — J. Gregory Pickett
*Assistant Examiner* — Niki M Eloshway
(74) *Attorney, Agent, or Firm* — Carlson, Gaskey & Olds PC

(57) ABSTRACT

A waste container includes a body having a base and a side wall extending upward from the base to define a container interior. A lid is hingeably secured to an upper portion of the side wall. A latch assembly selectively secures the lid to the side wall, the latch assembly including a rotatable latch portion having a latch member selectively interlocking with a hook portion.

19 Claims, 13 Drawing Sheets

WASTE CONTAINER WITH IMPROVED LATCH

This application claims priority to U.S. Provisional Application Ser. Nos. 61/380,557, filed Sep. 7, 2010 and 61/451,738, filed Mar. 11, 2011.

BACKGROUND

Waste containers, such as for trash, recycling, or organic waste (compost), etc., often attract the interest of animals, such as rodents, dogs, raccoons, etc. Many containers include lids that latch, but some animals can pry under the lid and force the container open.

For areas where the collection trucks include cart lifters, the containers might become damaged if they are lifted and dumped while latched.

SUMMARY

A waste container includes a body having a base and a side wall extending upward from the base to define a container interior. A lid is hingeably secured to an upper portion of the side wall. A latch assembly selectively secures the lid to the side wall, the latch assembly including a rotatable latch portion having a latch member selectively interlocking with a hook portion.

In an independent feature, the body includes a lip projecting outward from the upper portion of the side wall and an outer rib protrudes upward from the lip. The outer rib is outward of the lid, to prevent animals from prying under the lid.

DETAILED DESCRIPTION OF A PREFERRED EMBODIMENT

Figure 2:
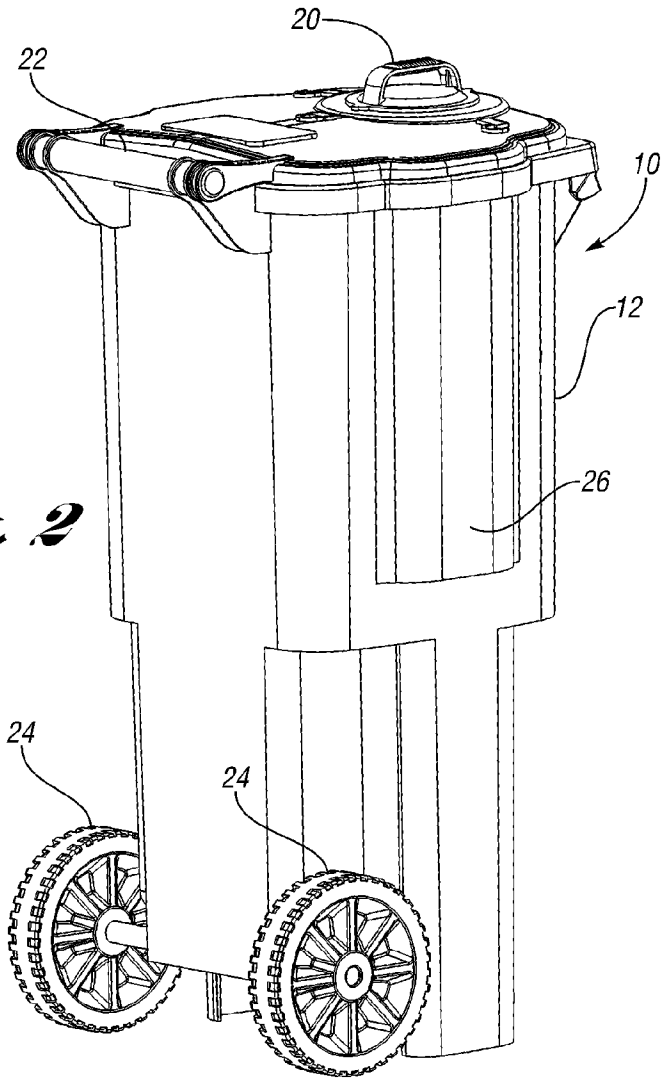
FIG. 2 is a rear perspective view of the container of FIG. 1.
Figure 1:
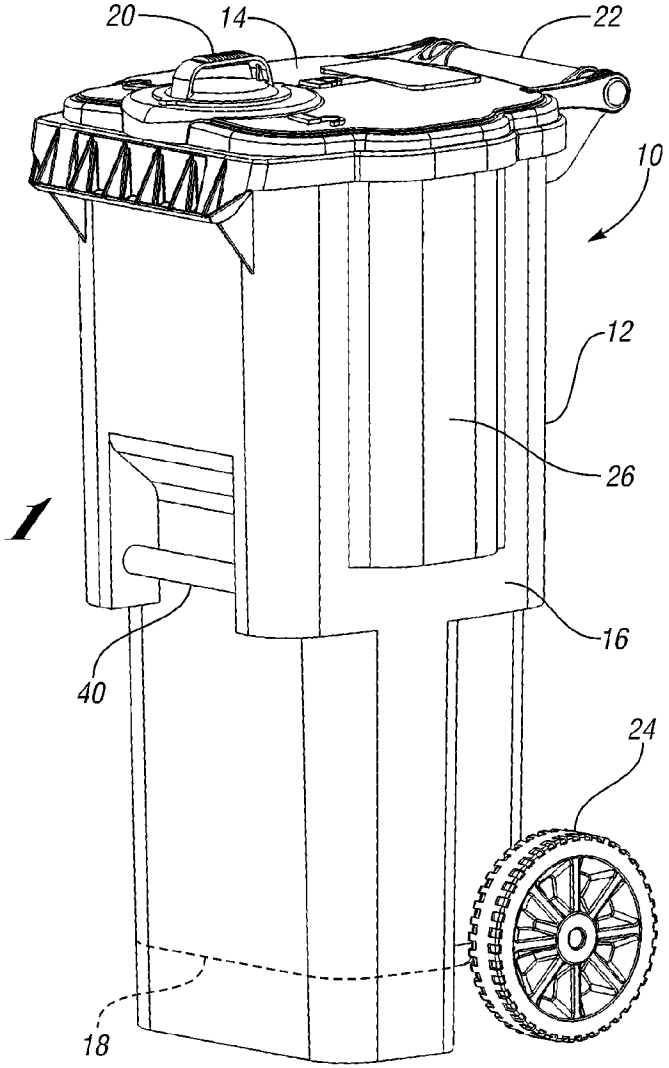
FIG. 1 is a front perspective view of a waste container according to one embodiment.

A container, such as a roll out cart 10, according to one embodiment of the present invention is shown in FIGS. 1 and 2. The roll out cart 10 generally includes a container body 12 and a lid 14 pivotably connected to the container body 12 for selectively providing access to an interior of the container 12. The container body 12 includes a side wall 16 extending upwardly from a base 18 to define the container interior. A latch 20 selectively prevents the lid 14 from opening. In FIG. 1, the latch 20 is shown in the latched (locked) position, in which the lid 14 cannot be opened.

The roll out cart 10 may include a handle 22 and wheels 24 to facilitate moving the roll out cart 10. The side walls 16 of the container body 12 includes expanded portions 26 (one is shown in FIG. 1 and the other is shown in FIG. 2) to facilitate the roll out cart 10 being grasped by cart lifters. The roll out cart 10 may further include a grab bar 40 at a front of the container body 12 to further facilitate use with handling equipment, such as a cart lifter.

Figure 3:
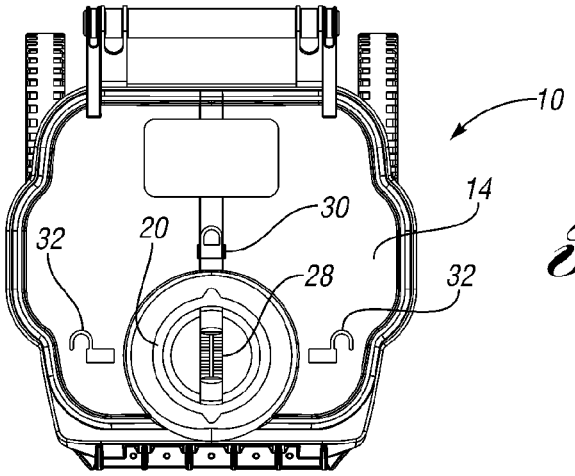
FIG. 3 is a top view of the container.

FIG. 3 is a top view of the roll out cart 10. The latch 28 is rotatable relative to the lid 14. Locked indicia 30 and unlocked indicia 32 may be molded into the upper surface of the lid. When the handle 28 of the latch 20 is rotated into alignment with the locked indicia 30, this indicates that the latch 20 is locked and the lid 14 cannot be opened. When the handle 28 of the latch 20 is rotated into alignment with the unlocked indicia 32, this indicates that the latch 20 is unlatched and the lid 14 can be opened.

Figure 4:
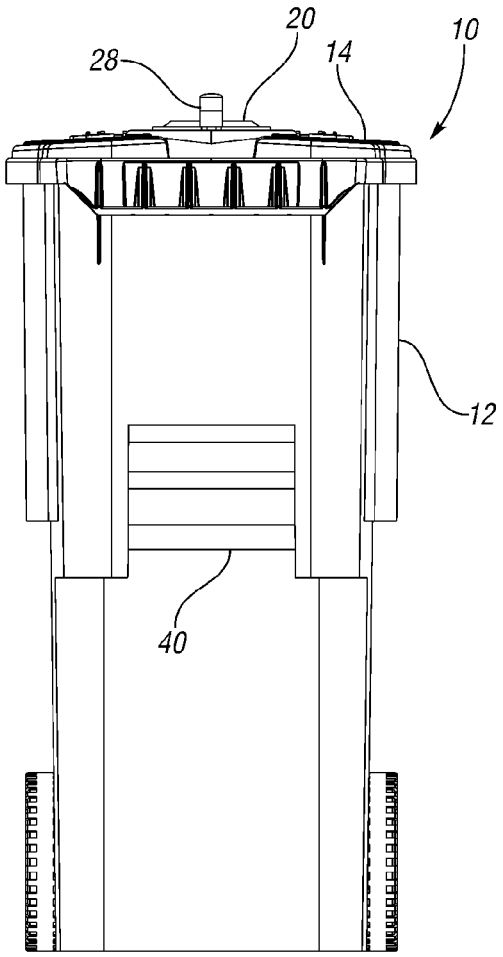
FIG. 4 is a front view of the container.
Figure 5:
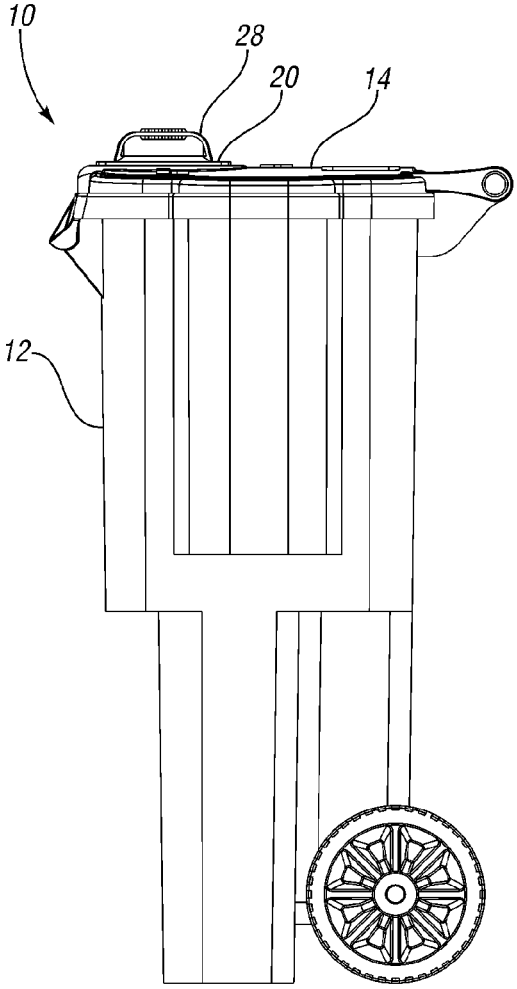
FIG. 5 is a side view of the container.

FIG. 4 is a front view of the roll out cart 10. FIG. 5 is a side view of the roll out cart 10.

Figure 6:
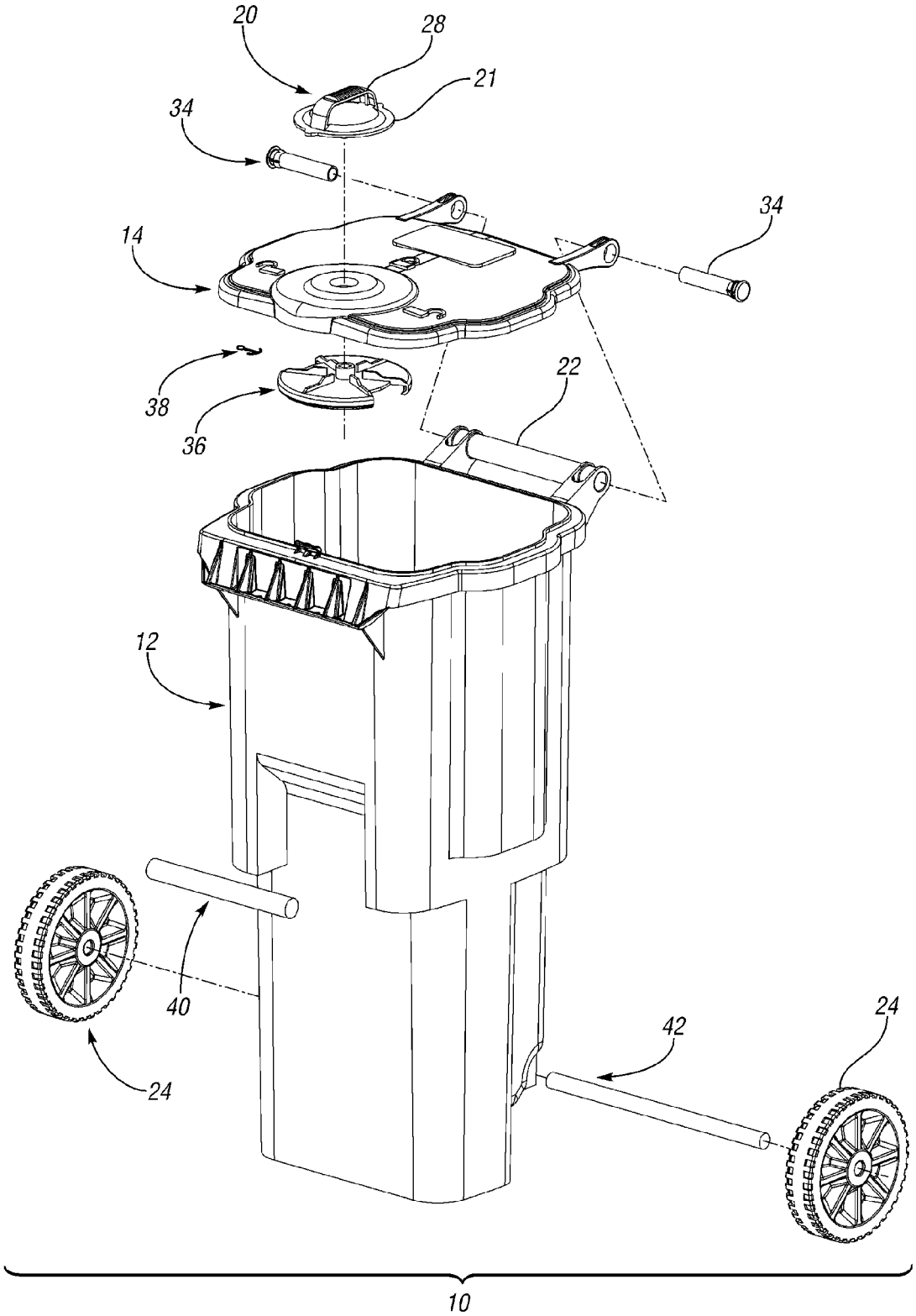
FIG. 6 is an exploded view of the container.

FIG. 6 is an exploded view of the roll out cart 10. The latch 20 includes the handle 28 as part of an upper latch portion 21. A pair of hinge pins 34 pivotably connect the lid 14 to the handle 22, which is integrally molded with the container body 12. The latch 20 further includes a generally disc-shaped lower latch portion 36 below the lid 14 and secured to the upper latch portion 21 via a lock pin 38. The grab bar 40, wheels 24 and wheel axle 42 are also shown in FIG. 6.

Figure 7:
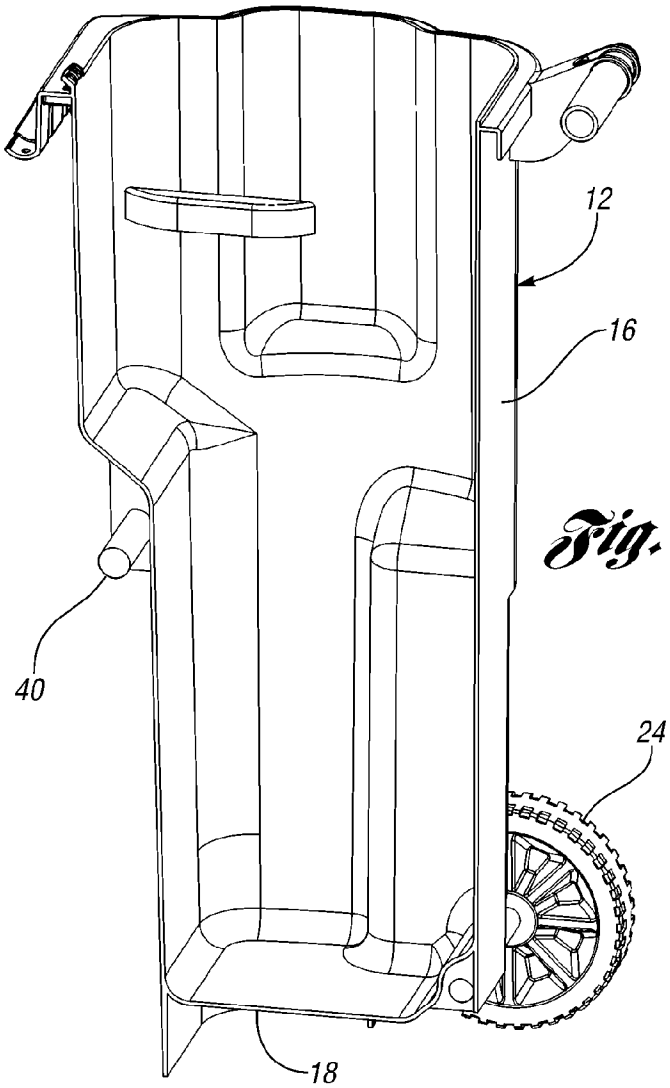
FIG. 7 is an interior perspective view of half of the container body.

FIG. 7 is a perspective view of half of the container body 12. As shown, the grab bar 40 does not extend into the interior of the container body 12. As a result, there are no holes through the side wall 16 or base 18, which prevents leakages. The corners of the side walls 16 include large blends to make it easier for waste to empty out and to make the container body 12 easier to clean. A lower rear portion of the container body 12 includes a reinforced area which carries the axle for the wheels 24.

Figure 8:
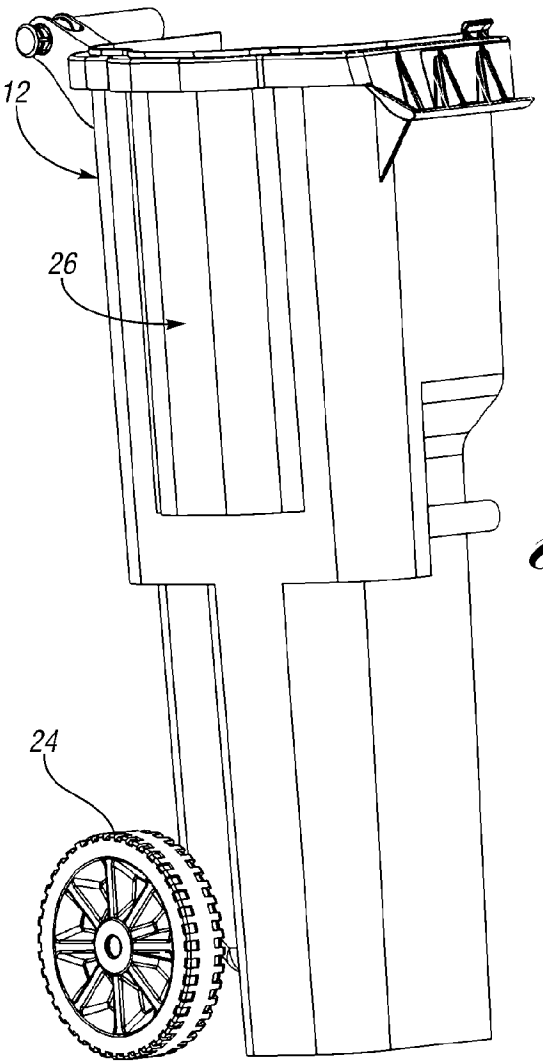
FIG. 8 is an exterior perspective view of the container body half of FIG. 7.

FIG. 8 is an external view of the half of the container body of FIG. 7.

Figure 9:
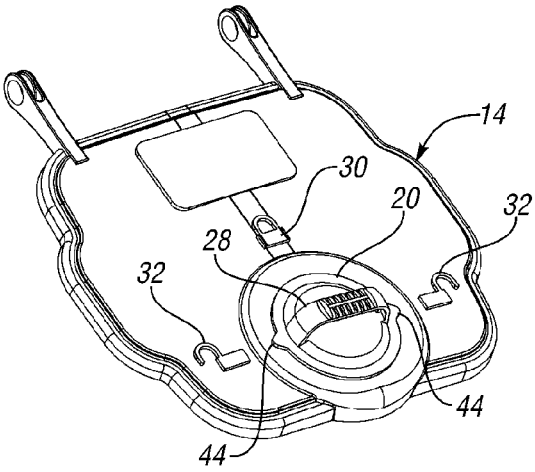
FIG. 9 is a perspective view of the lid and latch assembly of FIG. 1 in an unlocked position.

FIG. 9 is a perspective view of the lid 14, showing the latch 20 rotated to the unlocked position, in which the handle 28 is aligned with the unlocked indicia 32. The latch 20 further includes a pair of indicators 44, which are aligned with the handle 28, to further provide an indication of the position of the latch 20 relative to the indicia 30, 32.

Figure 10:
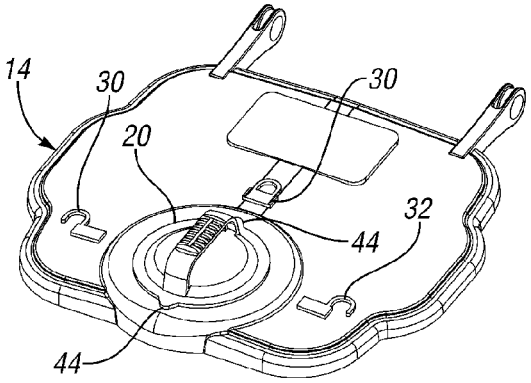
FIG. 10 is a perspective view of the lid and latch assembly of FIG. 1 in a locked position.

FIG. 10 shows the lid 14 with the latch 20 rotated such that the handle 28 and indicators 44 are aligned with the locked indicia 30.

Figure 11:
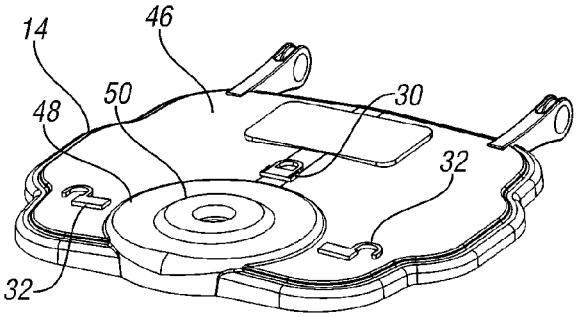
FIG. 11 is a perspective view of the lid without the latch assembly.

FIG. 11 shows the lid 14 with the latch 20 removed. The lid 14 includes a raised inner annular portion 50 circumscribing an opening through the lid 14. A second outer annular portion 48 is lower than the inner annular portion 50 but higher than the surrounding portions of the lid 14. The raised annular portions 48, 50 assist in preventing water and dirt from intruding into the latch area.

Figure 12:
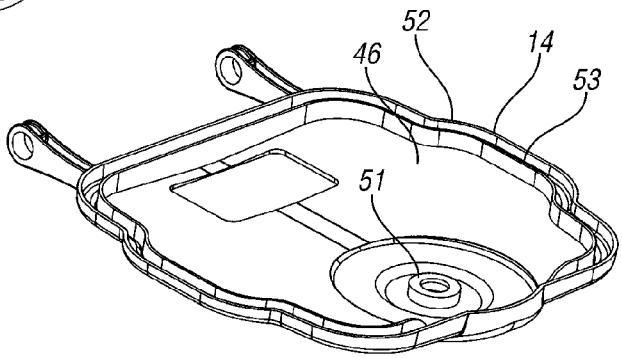
FIG. 12 is a bottom perspective view of the lid of FIG. 11.

FIG. 12 is a bottom perspective view of the lid 14. The lid 14 includes a lower annular portion 51 protruding downwardly around the opening through the lid 14. An outer lip 52 protrudes downwardly around the periphery of the lid 14. An inner lip 53 protrudes downwardly and is spaced inwardly of the outer lip 52. The spaced apart peripheral lips 52, 53 add strength to the lid 14 and help reduce odor from leaving the interior of the roll out cart 10.

Figure 13:
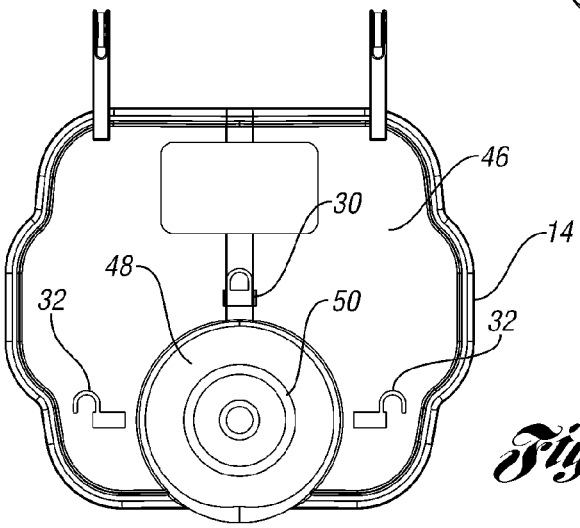
FIG. 13 is a top view of the lid of FIG. 11.

FIG. 13 is a top view of the lid 14 with the latch removed.

Figure 14:
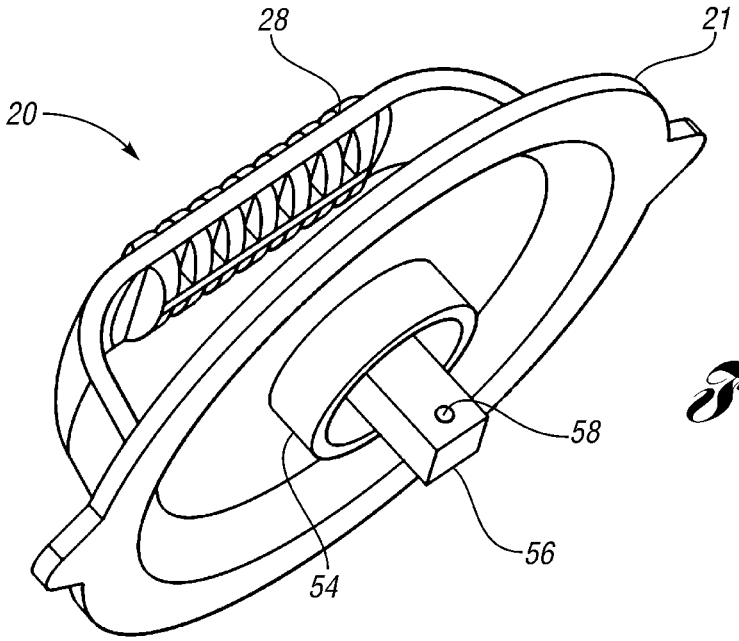
FIG. 14 is a bottom perspective view of the upper and lower latch portions.

FIG. 14 is bottom perspective view of the upper portion 21 of the latch 20. The upper portion 21 of the latch 20 includes a lower annular portion 54 and a shaft 56 protruding downwardly of the lower annular portion 54. An opening 58 for receiving the locking pin 38 is formed near a lower end of the shaft 56.

Figure 15:
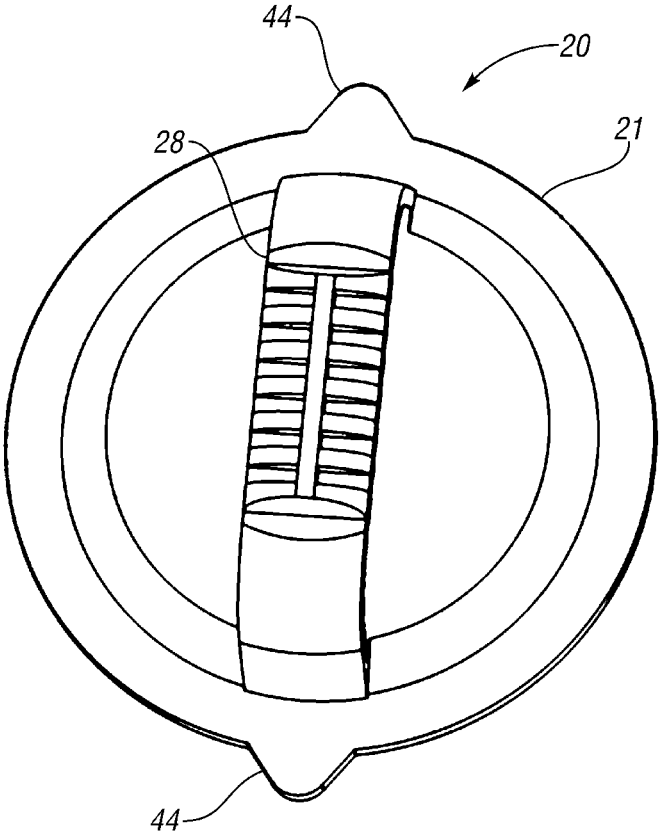
FIG. 15 is a perspective view of the upper latch portion.

FIG. 15 is an upper perspective view of the upper portion 21 of the latch 20.

Figure 16:
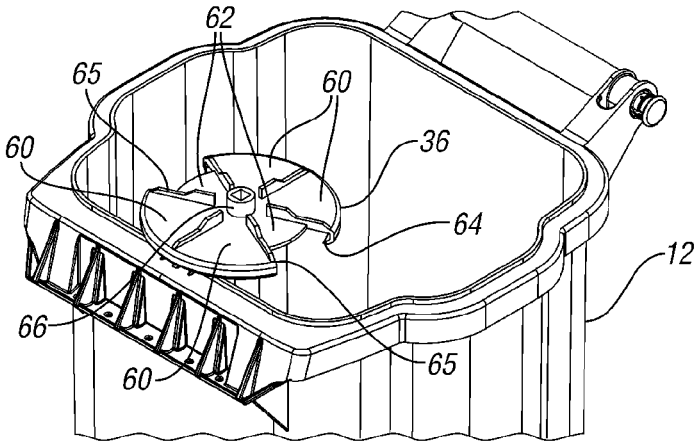
FIG. 16 is a perspective view of the lower latch portion engaging the body.
Figure 18:
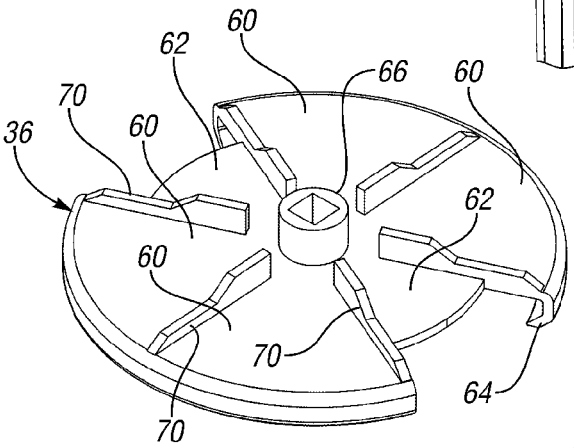
FIG. 18 is a perspective view of the lower latch portion.

FIG. 16 shows the container body 12 with the lower portion 36 of the latch 20 in position in the locked position. Referring to FIG. 18, the lower portion 36 is generally disc-shaped and includes large diameter portions 60 and small diameter portions 62. Notches are defined between the large diameter portions 60, outward of the small diameter portions 62. In this example, the large diameter portions together occupy approximately ⅔ of the circumference of the lower latch portion 36, while the two opposed small diameter portions 62 together comprise approximately the remaining ⅓ of the circumference of the lower latch portion 36 (approximately 60° each). Alternatively, a single small diameter portion 62 could be provided. Further, alternatively, the larger diameter portions 60 and small diameter portions 62 could have different relative sizes, depending upon the application or depending upon user preferences.

Sweeper ribs 70 protrude upwardly between adjacent larger diameter portions 60 and small diameter portions 62. The sweeper ribs 70 extend radially outwardly from an upper generally cylindrical portion 66 having an opening formed therein, which is complementary to the shaft 56 of the upper latch portion 21. The sweeper ribs 70 clean out waste that may get into the latch area during rotation of the handle 28. A latch member 64 protrudes downwardly and radially inwardly from an outer periphery of the larger diameter portions 60 of the lower latch portion 36. As shown, the latch member 64 may be arcuate.

Figure 19:
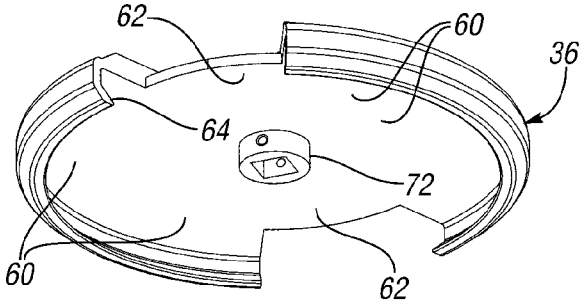
FIG. 19 is a bottom perspective view of the lower latch portion.

As shown in FIG. 19, a lower annular portion 72 protrudes downwardly of the lower latch portion 36, and includes a central opening therethrough complementary in shape to the shaft 56 of the upper latch portion 21. The lower annular portion 72 further includes a transverse opening for receiving the latch pin 38.

Figure 17:
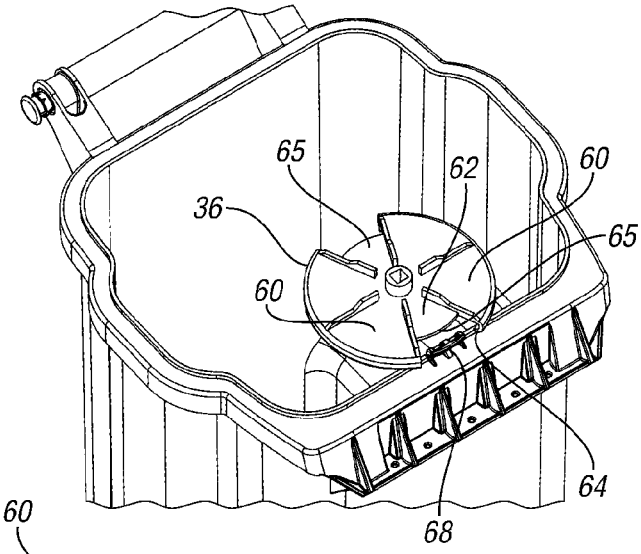
FIG. 17 is a perspective view of the lower latch portion and body of FIG. 16 in an unlocked position.
Figure 20:
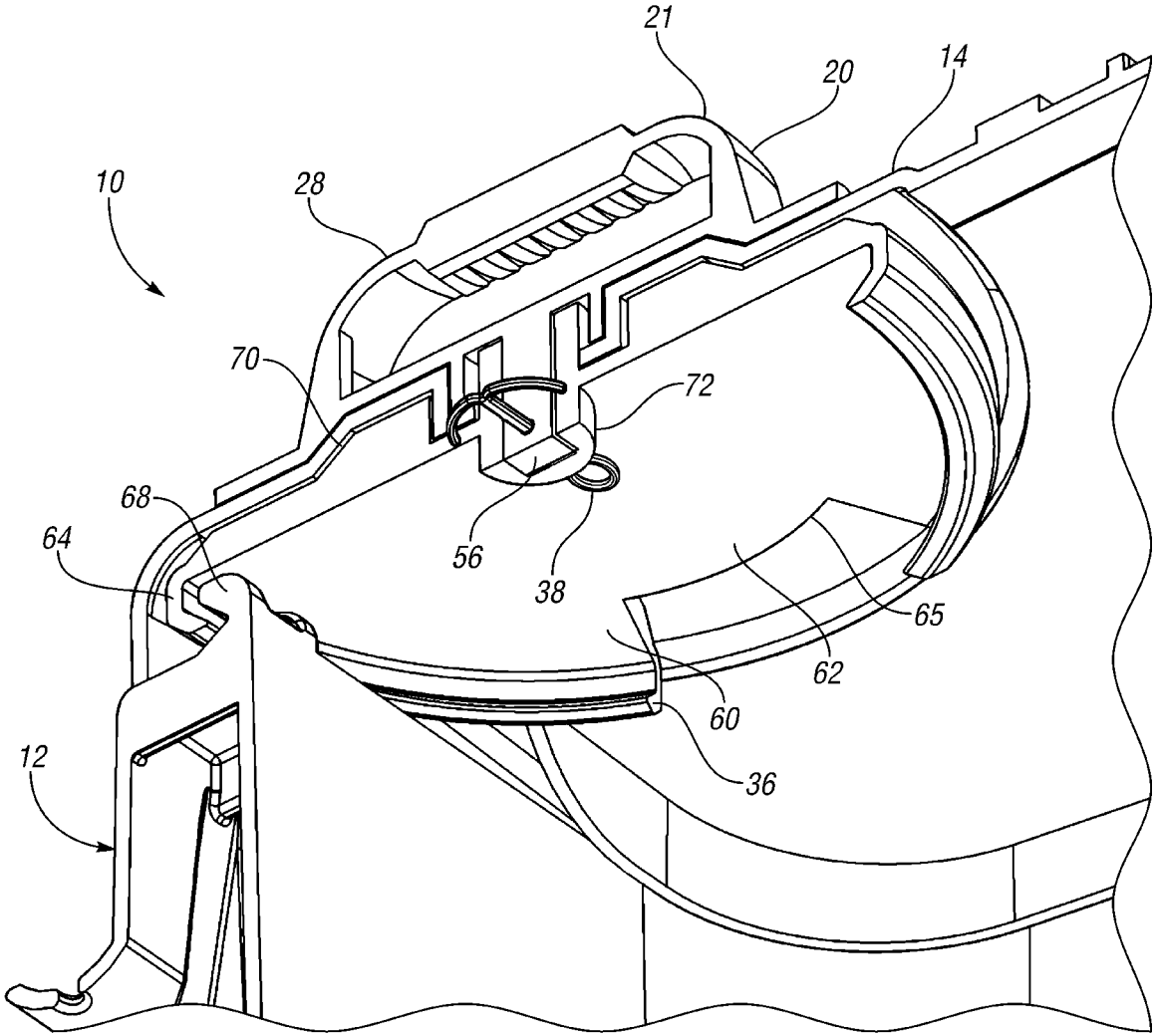
FIG. 20 is a bottom perspective view, broken away, of the container with the latch assembly in the locked position.

As shown in FIGS. 17 and 20, a forward facing hook 68 is formed adjacent an upper edge of the container body 12. The hook 68 engages the latch member 64 of the latch lower portion 36 thus, latching the lid 14 to the container body 12. The latch assembly includes the upper latch portion 21, lower latch portion 36 and hook 68. As also shown in FIG. 20, the shaft 56 of the upper latch portion 21 is received through the opening in the lid 14 and through the opening in the lower annular portion 72 in the lower latch portion 36 and secured there with the locking pin 38.

In use, a user places waste in the container body 12 and rotates the handle 28 of the latch 20 about an axis generally transverse to the lid 14 to the locked position, in which the handle 28 is aligned with the locked indicia 30. This latches the lid 14 to the container body 12 as shown in FIG. 20. This prevents rodents or other animals from accessing the contents of the roll out cart 10. The latch assembly is more durable and resistant to being pried open than previous latches. On waste pick-up day, the user can wheel the roll out cart 10 to the curb and then rotate the handle 28 of the latch 20 to the unlocked position, where the hook 68 on the container body 12 would be aligned with one of the smaller diameter portions 62 of the lower latch portion 36. When the driver of the waste truck arrives, the driver can see whether the lid 14 is locked or unlocked. If the lid 14 is unlocked, the driver can use the cart lifter on the truck (e.g. using the grab bar 40 and/or portions 26 of the side walls 16) to lift the roll out cart 10 and dump the contents into the truck. If the driver sees that the handle 28 of the latch 20 is still in the locked position, the driver will not attempt to dump the cart 10 while the lid is latched.

Figure 21:
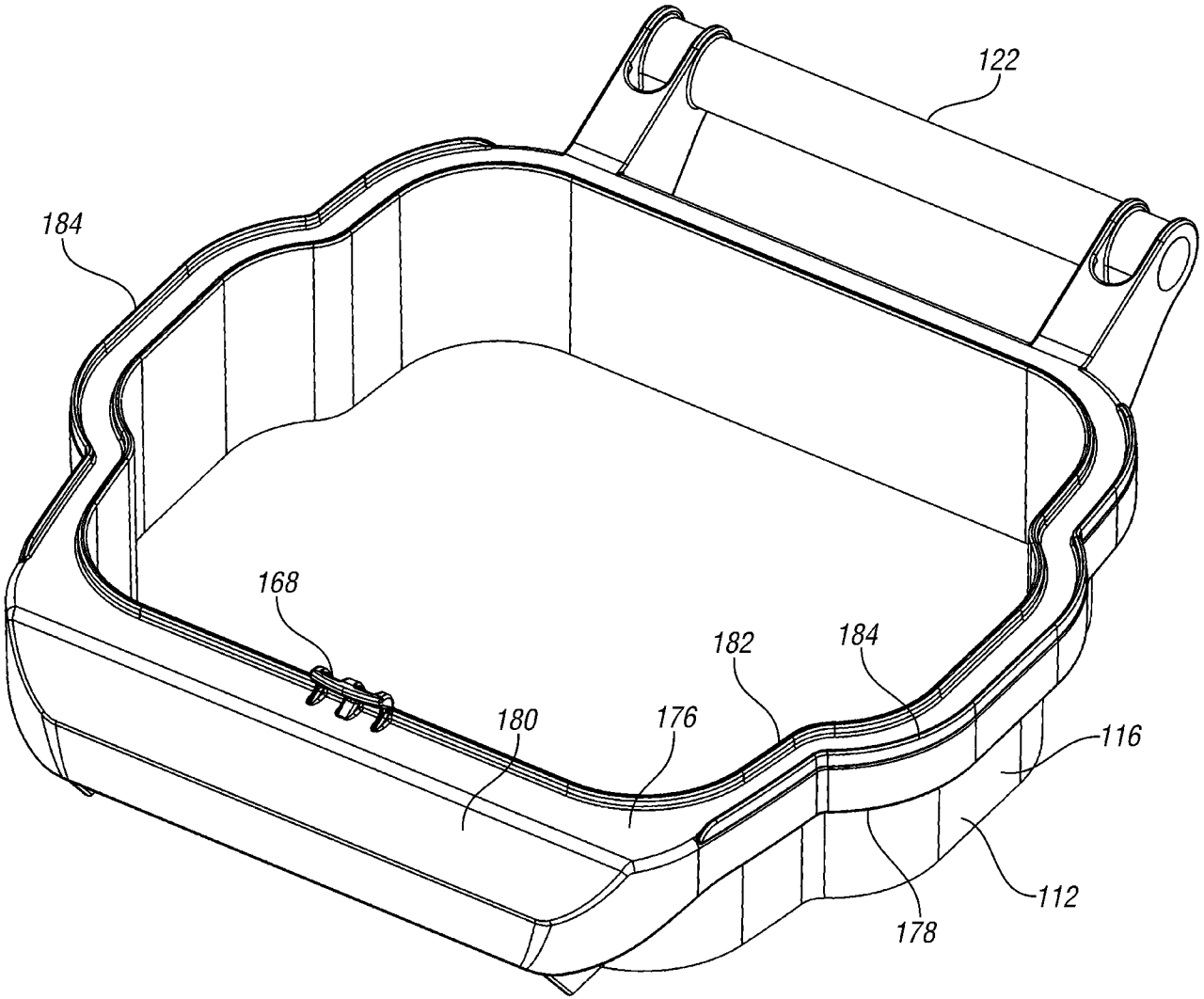
FIG. 21 is a perspective view of an upper portion of an alternate body that could be used in the container of FIGS. 1-20.
Figure 22:
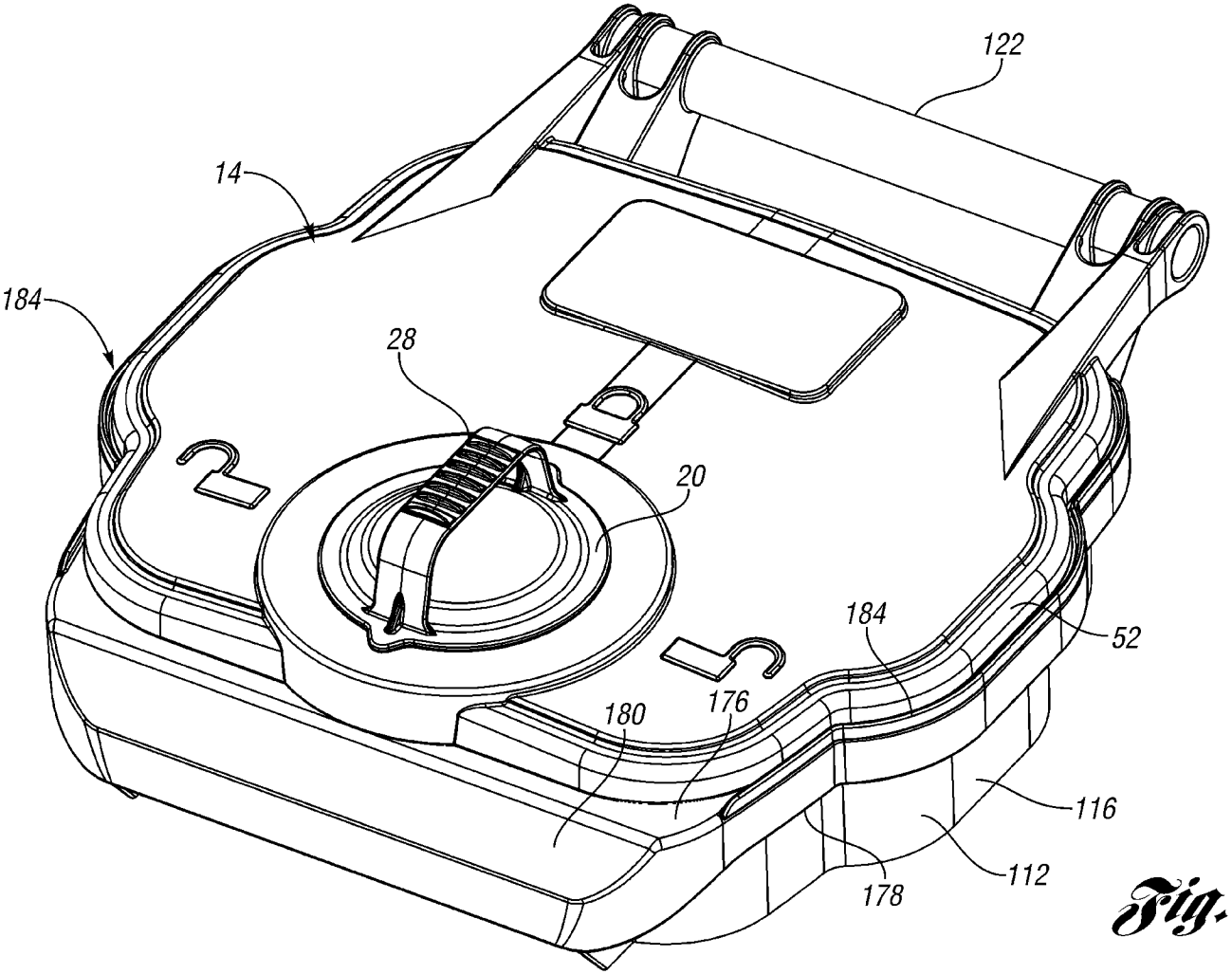
FIG. 22 shows the body of FIG. 21 with the lid and latch assembly.
Figure 23:
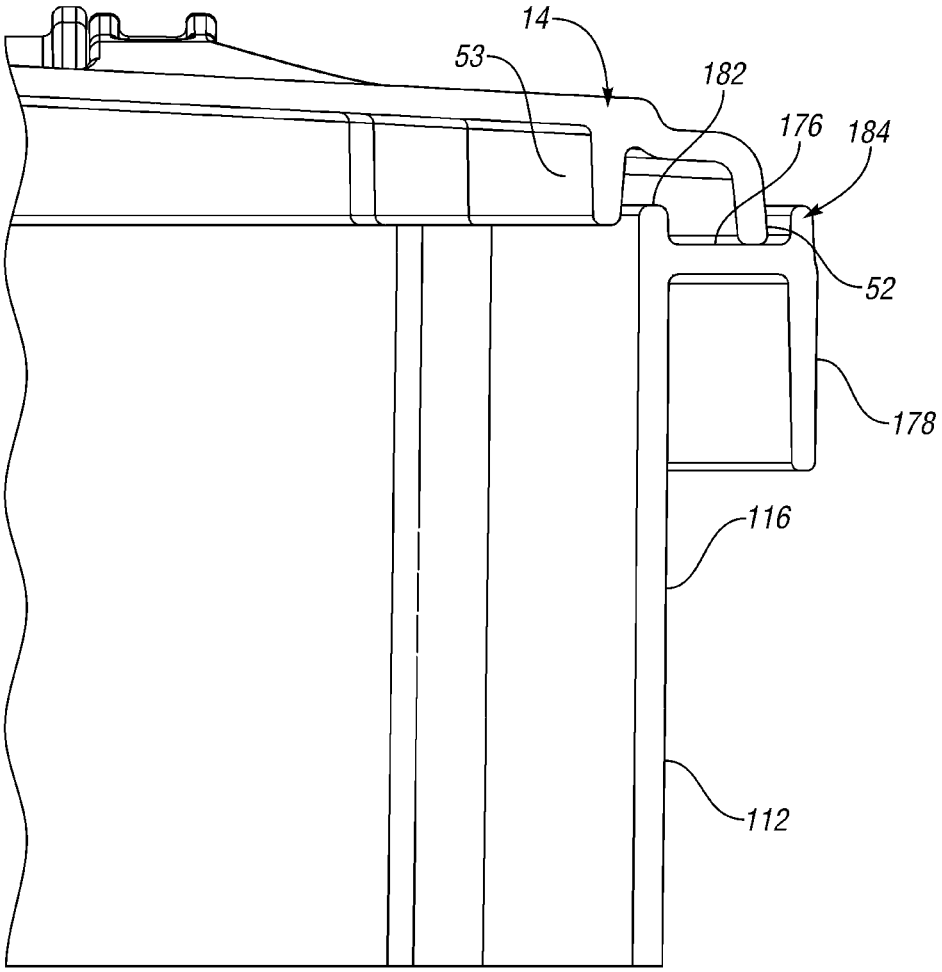
FIG. 23 is a section view through the lid and body of FIG. 22.

FIGS. 21-23 illustrate an alternative container body 112 for use with the lid 14 of FIGS. 1-20. Referring to FIG. 21, the container body 112 includes a side wall 116 and an upper lip including an upper lip wall 176 extending outwardly from an uppermost edge of the side wall 116 and a flange 178 extending downwardly from an outermost edge of the upper lip wall 176. The lip includes an apron portion 180 projecting forwardly and downwardly from the front of the container body 112 in front of the hook 168. An inner rib 182 projects upwardly from an inner periphery of the upper lip wall 176. An outer rib 184 projects upwardly from the side edges of each outer periphery of the upper lip wall 176. The outer rib 184 is taller than the inner rib 182. The outer rib 184 extends generally from the handle 122 to the apron portion 180.

FIG. 22 shows the lid 14 of FIGS. 1-20 on the alternative container body 112. FIG. 23 is a section view through one side of the container body 112 and lid 14. Referring to FIGS. 22 and 23, the outer lip 52 of the lid 14 contacts the upper lip wall 176 of the container body 112 between the inner rib 182 and the outer rib 184. The inner lip 53 of the lid 14 is received inward of the inner rib 182.

In use, the outer rib 184 prevents rodents from being able to pry under the lid 14. The outer rib 184 is not necessary near the handle 122 because that is where the lid 14 is attached to the container body 112. Similarly, the outer rib 184 is not necessary near the latch 28 because the lid 14 is also attached to the container body 112 there.

Figure 24:
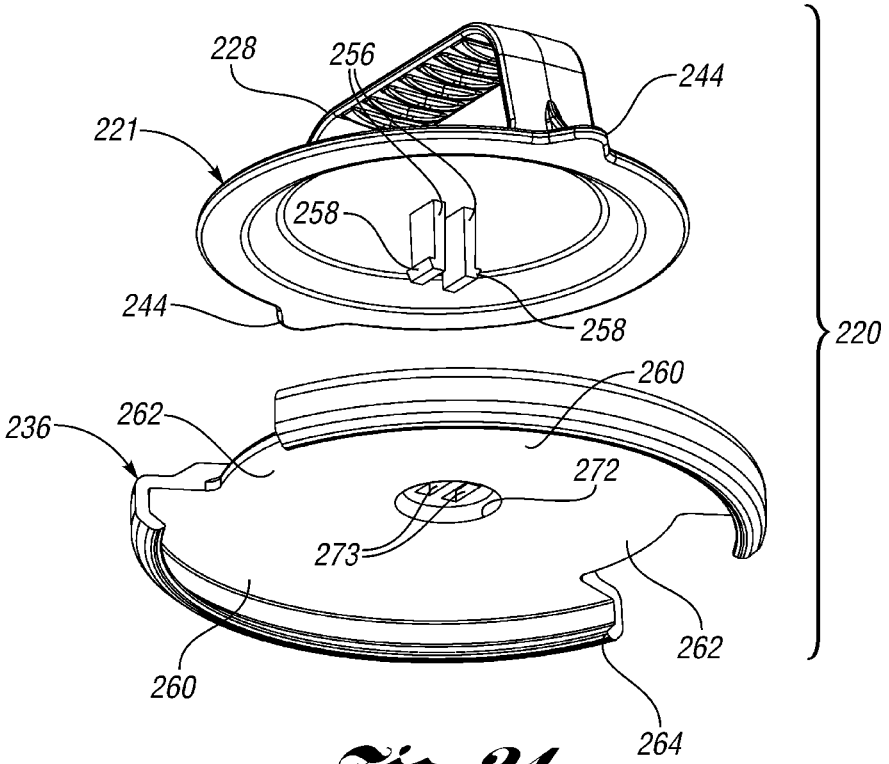
FIG. 24 is an exploded, bottom perspective view of an alternative upper latch portion and alternative lower latch portion.
Figure 25:
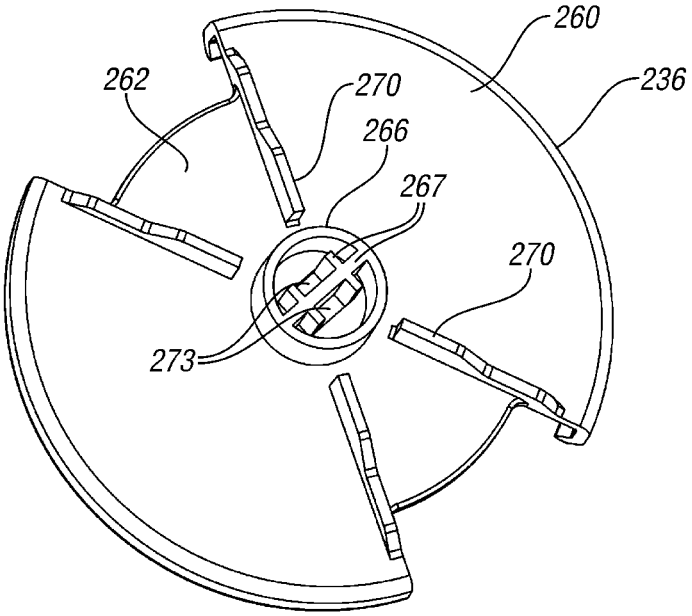
FIG. 25 is a perspective view of the lower latch portion of FIG. 24.
Figure 26:
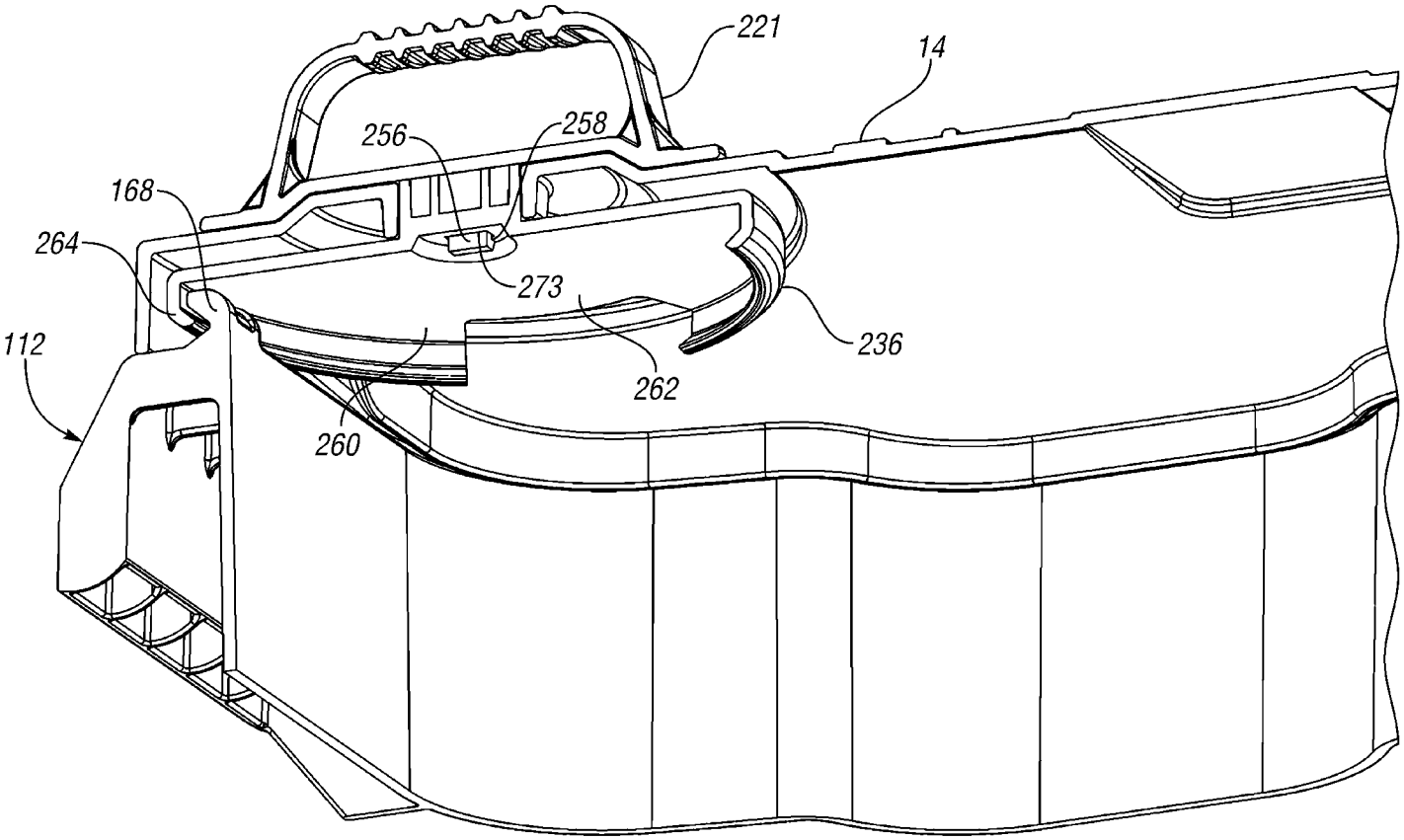
FIG. 26 is a bottom perspective view, broken away, of the container with the alternative latch assembly of FIG. 24 in the locked position

An alternate latch 220 is shown in FIGS. 24-26. The latch 220 includes an upper latch portion 221 and a lower latch portion 236. The upper latch portion 221 includes a handle 228 and indicators 244. The upper latch portion 221 includes a pair of snap-fit connector legs 256 extending downward to a pair of snap-tabs 258.

The lower latch portion 236 is generally disc-shaped and includes large diameter portions 260 and small diameter portions 262. In this example, the large diameter portions together occupy approximately ⅔ of the circumference of the lower latch portion 236, while the two opposed small diameter portions 262 together comprise approximately the remaining ⅓ of the circumference of the lower latch portion 236 (approximately 60° each). Alternatively, a single small diameter portion 262 could be provided. Further, alternatively, the larger diameter portions 260 and small diameter portions 262 could have different relative sizes, depending upon the application or depending upon user preferences.

A latch member 264 protrudes downwardly and radially inwardly from an outer periphery of the larger diameter portions 260 of the lower latch portion 236. A center recess 272 is formed in the center of the lower latch portion 236, and includes a pair of connector openings 273 therethrough complementary to the connectors 256 of the upper latch portion 221.

Referring to FIG. 25, sweeper ribs 270 protrude upwardly between adjacent larger diameter portions 260 and small diameter portions 262. The sweeper ribs 270 extend radially outwardly from an upper generally cylindrical portion 266 having ribs 267 formed therein that are complementary to the connectors 256 of the upper latch portion 221. The ribs 267 are adjacent the connector openings 273. The sweeper ribs 270 clean out waste that may get into the latch area during rotation of the handle 228.

In FIG. 26, the alternative latch 220 is shown on the container with the lid 14 and body 112 (of course, it could also be used with body 12). The hook 168 engages the latch member 264 of the latch lower portion 236 thus, latching the lid 14 to the container body 112. As also shown in FIG. 26, the connectors 256 (one shown) of the upper latch portion 221 are received through the opening in the lid 14 and through the openings 273 in the lower latch portion 236 and secured there by the snap-tabs 258.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope. For example, although the lid and latch are shown in use with a waste container with wheels and a handle, the lid and latch could be used with a container without wheels or a handle.

What is claimed is:

1. A waste container including:

a body having a base and a side wall extending upward from the base to define a container interior;

a lid hingeably secured to an upper portion of the side wall, wherein the lid is hingeably connected proximate a rearward portion of the upper portion of the side wall opposite a front portion of the side wall; and a latch assembly selectively securing the lid to the side wall, the latch assembly selectively securing the lid only to the front portion of the side wall, the latch assembly including a rotatable latch portion rotatable about an axis, the rotatable latch portion having a latch member movable about the axis, the latch member selectively interlocking with a hook portion.

2. The waste container of claim 1 wherein the axis is generally transverse to the lid.

3. The waste container of claim 1 wherein the rotatable latch portion includes a large diameter portion and a small diameter portion, the latch member formed on the large diameter portion.

4. The waste container of claim 3 wherein the latch member extends downward and then radially inward.

5. The waste container of claim 4 wherein the latch member is arcuate.

6. The waste container of claim 5 wherein the latch member extends downward and inward from an outer periphery of the large diameter portion.

7. The waste container of claim 1 wherein the body includes a horizontal lip projecting outward from the upper portion of the side wall, an outer rib protruding upward from the lip outward of the lid when the lid is closed.

8. The waste container of claim 1 wherein the latch portion is a lower latch portion below the lid, the latch assembly further including an upper latch portion above the lid, the upper latch portion secured to the lower latch portion, the upper latch portion including a handle.

9. The waste container of claim 8 wherein the upper latch portion includes an indicator indicating whether the latch assembly is latched or unlatched.

10. The waste container of claim 8 wherein the upper latch portion is snap-fit connected to the lower latch portion.

11. The waste container of claim 1 wherein the rotatable latch portion includes a plurality of ribs extending radially outward relative to the axis.

12. The waste container of claim 1 wherein the latch member is one of a plurality of latch members, the rotatable latch portion including the plurality of latch members, any of which can selectively interlock with the hook portion by rotation of the rotatable latch portion.

13. A waste container including:

a body having a base and a side wall extending upward from the base to define a container interior;

a lid hingeably secured to an upper, rear portion of the side wall; and a latch assembly selectively securing the lid to the side wall, the latch assembly including a rotatable latch portion rotatable about an axis, the rotatable latch portion having a latch member movable about the axis, the latch member selectively interlocking with a hook portion, wherein the hook portion is on a front portion of the side wall and wherein the hook portion is forward-facing, such that the latch member selectively interlocks on a forward-facing side of the hook portion.

14. A waste container including:

a body having a base and a side wall extending upward from the base to define a container interior;

a lid hingeably secured to an upper portion of the side wall; and a latch assembly selectively securing the lid to the side wall, the latch assembly including a rotatable latch portion rotatable about an axis, the rotatable latch portion having a latch member movable about the axis, the latch member selectively interlocking with a hook portion, wherein the latch member is rotatable with the rotatable latch portion, the latch member rotating about the axis into and out of a latched position in which the latch member interlocks with the hook portion, the axis generally transverse to the lid, wherein the rotatable latch portion includes a large diameter portion and a small diameter portion, the latch member formed at an outer periphery of the large diameter portion wherein the latch member extends downward and then radially inward from an outer periphery of the large diameter portion.

15. The waste container of claim 14 wherein the lid is hingeably connected to a handle spaced rearwardly of a rearward portion of the upper portion of the side wall.

16. A waste container including:

a body having a base and a side wall extending upward from the base to define a container interior;

a lid hingeably secured to an upper rear portion of the side wall; and a latch assembly selectively securing the lid to the side wall, the latch assembly including a latch member selectively rotatable about an axis generally transverse to the lid and to the base into and out of a latched position in which the latch member interlocks with a hook portion and prevents the lid from opening, wherein the latch member extends downward and then radially inward below the hook portion when the latch member is in the latch position.

17. The waste container of claim 16 wherein the hook portion extends upward and forward from a front portion of the side wall.

18. The waste container of claim 16 wherein the body includes a lip projecting outward from an upper front portion of the side wall, an outer rib protruding upward from the lip outward of the lid.

19. A waste container including:

a body having a base and a side wall extending upward from the base to define a container interior;

a lid hingeably secured to an upper portion of the side wall; and a latch assembly selectively securing the lid to the side wall, the latch assembly including a rotatable latch portion rotatable about an axis, the rotatable latch portion having a latch member movable about the axis, the latch member selectively interlocking with a hook portion, wherein the latch member is rotatable with the rotatable latch portion, the latch member rotating about the axis into and out of a latched position in which the latch member interlocks with the hook portion, the axis generally transverse to the lid, wherein the latch member is arcuate about the axis wherein the latch member extends arcuately about the axis approximately ⅓ of a circumference of the rotatable latch portion.

* * * * *